United States Patent [19]

Costello et al.

[11] 4,223,930

[45] Sep. 23, 1980

[54] SECURITY DEVICE FOR WINDOW LOCKS

[75] Inventors: Michael Costello, East Boston; John E. Costello, Saugus, both of Mass.

[73] Assignee: Meridian Safety Products, Inc., Boston, Mass.

[21] Appl. No.: 823

[22] Filed: Jan. 4, 1979

[51] Int. Cl.[2] ..... E05C 3/38

[52] U.S. Cl. ..... 292/346; 292/241

[58] Field of Search ..... 292/341.18, 346, 340, 292/241

[56] References Cited

U.S. PATENT DOCUMENTS

| | | | |
|---|---|---|---|
| 1,399,897 | 12/1921 | Singer | 292/346 |
| 2,796,281 | 6/1957 | Philpott | 292/346 |
| 2,816,788 | 12/1957 | Henry | 292/346 |
| 3,837,191 | 9/1974 | Soiderer | 292/346 |
| 3,966,248 | 6/1976 | James | 292/341.18 |
| 4,102,546 | 7/1978 | Costello | 292/346 |

FOREIGN PATENT DOCUMENTS

| | | | |
|---|---|---|---|
| 240706 | 10/1925 | United Kingdom | 292/346 |

*Primary Examiner*—Richard E. Moore

*Attorney, Agent, or Firm*—Morse, Altman, Oates & Bello

[57] ABSTRACT

A security device is provided for installation on double hung windows to prevent the window lock from being jimmied open from the outside and to tighten the windows sashes to the frame as well as to each other when locked. The device is in the form of a generally flat plate or shield that is installed under the window latch and is formed with a pair of fingers which extend across the gap between the upper and lower sashes on either side of the keeper. Reentrant openings are formed from the edge of the shield to allow easy installation and a central portion of reduced thickness introduces a slight tilt to the latch to provide an improved locking grip with the keeper.

5 Claims, 4 Drawing Figures

SECURITY DEVICE FOR WINDOW LOCKS

BACKGROUND OF THE INVENTION

1. Field of the Invention

This invention relates generally to security devices for windows and more particularly is directed towards a new and improved shield for preventing unauthorized opening of double hung windows and to tighten double hung windows when locked.

2. Description of the Prior Art

A great majority of double hung windows now in use are locked shut by means of a two part window lock comprised of a keeper, which is fastened to the lower inner edge of the upper sash, and a movable latch fastened to the upper edge of the lower sash. When the sashes are in their closed positions, the latch is turned to engage the keeper and thereby lock the window. While such locks are in common use they are subject to being jimmied open from the outside by the insertion of a thin blade or similar tool between the sashes. Older windows in particular are susceptible to this type of forced entry, the blade being used to disengage the latch from the keeper whereby the window may be raised without breaking the glass. In U.S. Pat. No. 4,102,546 and U.S. application Ser. No. 868,076, filed Jan. 9, 1978, as well as in U.S. Pat. Nos. Des. 249,017 and 249,018 there are disclosed devices for use with double hung windows to prevent such windows from being jimmied open from the outside.

It is an object of the present invention to provide improvements in devices of the foregoing type.

Another object of this invention is to provide a device for portecting double hung window locks against illegal opening and facilitating the installation of such systems.

A further object of this invention is to provide a new and improved device for quickly and easily tightning the sashes of a double hung window against the window frame to reduce drafts through the window.

SUMMARY OF THE INVENTION

This invention features a device for simultaneously protecting the lock of a double hung window and tightening the sashes thereof, comprising a plate insertable under the latch of a sash lock, the plate being formed with a pair of reentrant openings in one edge thereof by means of which the plate may be installed by loosening the sash lock sufficiently to slip the plate under the lock. The plate is formed with integral fingers spanning the gap between the sashes to prevent a blade or thin tool from being used outside the window to jimmy open the lock and has a central portion of reduced thickness to introduce a slight tilt to the lock and improve the locking connection with the keeper.

DETAILED DESCRIPTION OF THE PREFERRED EMBODIMENT

Figure 1:
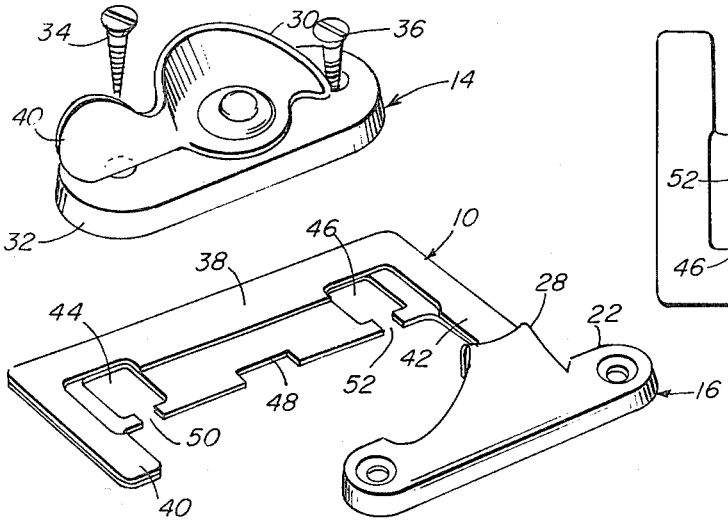
FIG. 1 is an exploded perspective view of the security device and a typical sash lock.
Figure 2:
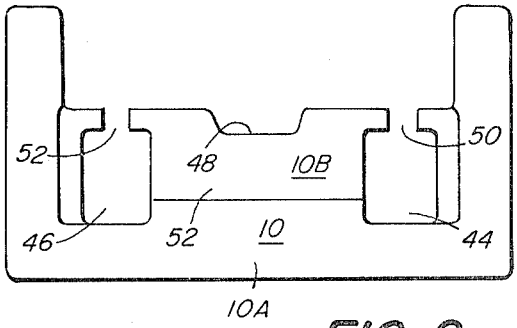
FIG. 2 is a top plan view of the device.

Referring now to the drawings, the reference character 10 generally indicates a shield plate for use primarily with a sash lock 12 of the sort used on double hung windows. As illustrated, a typical sash lock for a double hung window is comprised of a latch 14 and a keeper 16. Double hung windows typically are comprised of upper and lower sashes 18 and 20, respectively, with the upper sash being located outwardly of the lower sash. Both sashes are slidable mounted for a vertical movement and, when in a closed locked position, the lower inner edge of the upper sash lines up with the upper edge of the inner sash, with the two sashes locked together by turning the movable portion of the latch to engage the keeper. In many double hung windows, particularly those in older buildings, the sashes are somewhat loose fitting and a narrow gap may exist between the sashes through which a burglar may insert a knife blade or other thin tool and, by proper manipulation, twist the latch into an open position and thereby allow the window to be opened from the outside.

The sash lock parts 14 and 16 are secured tightly by screws to the window sashes with the keeper 16 screwed onto the lower part of the upper sash while the latch 14 is screwed onto the top of the lower sash. The keeper is comprised of a metal stamping or the like having a base portion 22 fastened to the upper sash by screws 24 and 26. The center of the base portion forms into an upright hook portion 28 to receive a rotatable locking cam 30 attached to the latch 14. The latch 14 includes a base portion 32 fastened to the inner sash by screws 34 and 36 with the cam 30 rotatably connected to the base portion by means of a pin 38. The locking cam is provided with a thumb tab 40 which allows the cam to be twisted from a locked to an unlocked position.

The shield plate 10, in the preferred embodiment, is comprised of top and bottom sections 10A and 10B stamped from a sheet metal such as steel, brass or the like, and laminated together as by spot welding. The shield is relatively small with a typical overall length of $3\frac{3}{8}''$ and an overall width of $1\frac{3}{4}''$. These dimensions are only by way of the example and can be increased or decreased as desired.

The bottom plate section 10B is formed with a main body portion 38 having an average width of approximately $1\frac{1}{8}''$ and defining a longitudinal rear edge which is generally straight while the opposite longitudinal edge is formed with a pair of forwardly projecting end fingers 40 and 42, a pair of reentrant openings 44 and 46 and a cutaway central notch 48. The fingers 40 and 42 extend from the ends of the plate and typically are about $\frac{5}{8}''$ long an $\frac{3}{8}''$ wide. The reentrant openings 44 and 46 commence at reduced slots 50 and 52 near the bases of the fingers and extend rearwardly into the enlarged openings 44 and 46. The openings 44 and 46 are elongated, typically being on the order of perhaps $\frac{1}{2}''$ long by perhaps $\frac{3}{4}''$ deep. The slots 50 and 52 are typically about 0.175" wide and extend parallel to one another from the forward edge of the plate to the elongated openings 44 and 46.

The center notch 48 is on the order of about 3/16" deep by about $\frac{5}{8}''$ wide.

Figure 4:
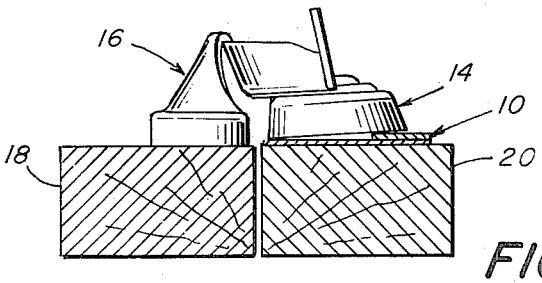

The upper plate section 10A has an outline along its rear and side edges that matches that of the plate section 10B so that these three edges of both section align when the plate sections are superimposed one upon the other. The body portion of the upper section joining the finger portions is much narrower than the corresponding portion of the lower section with the result that a central area 52 of the plate has a thickness that is one-half that of the remaining portion of the plate. The rear portion of the plate thus is thicker than the forward portion so that the latch 14, when mounted in place over the plate will be tilted slightly towards the keeper as shown in FIG. 4.

Figure 3:
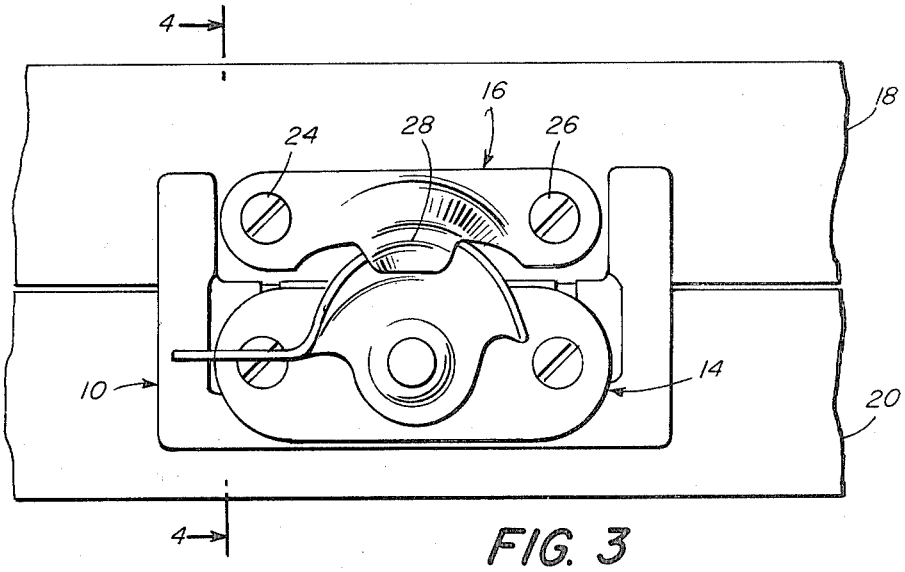
FIG. 3 is a top plan view of a typical installation arrangement of the device on a double hung window, and, FIG. 4 is a cross-sectional view taken along the line 4—4 of FIG. 3.

The plate 10 is installed by first loosening the screws 34 and 36 for the latch 14 if the device is being installed on an existing window lock. When the screws 34 and 36 are loosened sufficiently, the latch 14 is raised slightly so that the plate may be slipped in under the latch. The plate is positioned with the fingers 40 and 42 extending over the gap between the sashes and on either side of the keeper 12 in the manner best shown in FIG. 3. It is not necessary to remove the latch entirely since the slots 50, 52 allow the plate to be slipped in under the latch with the screws 34 and 36 in place. The plate is pushed fully in under the latch and there is sufficient clearance in their elongated openings 44 and 46 to accommodate variations in the size of the latch and the positions of the screws holding the latch in place. Sufficient play is provided so that the plate may be manually adjusted with respect to the keeper and the sashes so that the movements of the windows is not adversely effected. Once the plate is in its proper position, the screws are tightened to clamp the plate in place.

The function of the reduced thickness in the center portion of the plate is to maintain the latch at approximately the same level as the keeper so that the installation of the plate will not misalign the latch from the keeper. This also introduces a slight tilt to the latch which has been found to improve the locking effect between the latch and keeper. Also, since during the course of time, windows sashes will tend to loosen due to wear, shrinkage and the like, the installation of shield serves to provide means for compensating for wear and relative changes in sash dimensions. Thus, the lock parts not only are protected against being jimmied open from the outside, but also the window sashes may be secured more tightly to one another and to the window frame.

Having thus described the invention, what we claim and desire to obtain in my Letters Patent of the United States is:

1. A guard for use with the existing lock elements of a double-hung window having upper and lower sashes, both with a cooperating lock element, comprising (a) a unitary flat plate number adapted to be mounted between the top of said lower sash and the lower sash lock element, (b) said member being substantially flat throughout and including a main body portion formed with a contoured profile along one along edge thereof, (c) said one long edge including a pair of spaced parallel fingers extending one from each end of said one long edge and of equal length adapted to extend over the gap between said sashes when closed and beyond the inner opposing edge of said upper sash and to either side of the upper sash lock element, (d) said body portion being formed with a pair of spaced reentrant slot openings, one near each end thereof extending parallel to one another and originating at said one long edge in position to align with screw holes in said lower sash and said lower sash lock element and allow said guard to be slipped into position by loosening said lower sash look element, (e) said body portion being thinner in the area towards said one long edge and thicker in the area towards the other long edge whereby a lock element placed thereon will be tilted towards said one long edge.

2. A guard according to claim 1 wherein said long edge is formed with a center recess to allow clearance for the upper sash lock element when said window is being opened.

3. A guard for use with the existing lock elements of a double-hung window having upper and lower sashes, both with a cooperating lock element, comprising (a) a unitary flat plate member adapted to be mounted between the top of said lower sash and the lower sash lock element, (b) said member being substantially flat throughout and including a main body portion formed with a contoured profile along one long edge thereof, (c) said one long edge including a pair of spaced parallel fingers extending one from each end of said one long edge and of equal length adapted to extend over the gap between said sashes when closed and beyond the inner opposing edge of said upper sash and to either side of the upper sash lock element, (d) said body portion being formed with a pair of spaced reentrant slot openings, one near each end thereof extending parallel to one another and originating at said one long edge in position to align with screw holes in said lower sash and said lower sash lock element and allow said guard to be slipped into position by loosening said lower sash lock element (e) said plate member being comprised of upper and lower sections in superimposed bonded relation to one another, the lower said sections in outline defining the complete outline of said plate and the upper section formed with a body portion that is narrower than that of said lower section, the body portion of said upper section being disposed towards the other long edge of said portion.

4. A guard for use with the existing lock elements of a double-hung window having upper and lower sashes, both with a cooperating lock element, comprising (a) a unitary flat plate member adapted to be mounted between the top of said lower sash and the lower sash lock element, (b) said member being substantially flat throughout and including a main body portion formed with a contoured profile along one long edge thereof, (c) said one long edge including a pair of spaced parallel fingers extending one from each end of said one long edge and of equal length adapted to extend over the gap between said sashes when closed and beyond the inner opposing edge of said upper sash and to either side of the upper sash lock element, (d) said body portion being formed with a pair of spaced openings in position to align with screw holes in said lower sash and said lower sash lock element, (e) said body portion being thinner in the area towards said one long edge and thicker in the area towards the other long whereby a lock element placed thereon will be tilted towards said one long edge.

5. A guard for use with the existing lock elements of a double-hung window having upper and lower sashes, both with a cooperating lock element, comprising (a) a unitary flat plate member adapted to be mounted between the top of said lower sash and the lower sash lock element, (b) said member being substantially flat throughout and including a main body portion formed with a contoured profile along one long edge thereof, (c) said one long edge including a pair of spaced parallel fingers extending one from each end of said one long edge and of equal length adapted to extend over the gap between said sashes when closed and beyond the inner opposing edge of said upper sash and to either side of the upper sash lock element, (d) said body portion being formed with a pair of spaced openings in position to align with screw holes in said lower sash and said lower sash lock element, (e) said plate member being comprised of upper and lower sections in superimposed bonded relation to one another, the lower said sections in outline defining the complete outline of said plate and the upper section formed with a body portion that is narrower than that of said lower section, the body portion of said upper section being disposed towards the other long edge of said portion.

* * * * *